US009657255B2

(12) United States Patent
Maes et al.

(10) Patent No.: US 9,657,255 B2
(45) **Date of Patent: *May 23, 2017**

(54) LAUNDRY DETERGENT COMPOSITION

(71) Applicant: The Procter & Gamble Company, Cincinnati, OH (US)

(72) Inventors: Jef Annie Alfons Maes, Sint-Niklaas (BE); Johan Maurice Theo De Poortere, Merelbeke (BE); Jean-Francois Bodet, Waterloo (BE); Bruno Jean-Pierre Matthys, Brussels (BE); Alice Michele Boutoille, Brussels (BE); Lucia Fernandezmartinez, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/819,461

(22) Filed: Aug. 6, 2015

(65) Prior Publication Data

US 2016/0040099 A1 Feb. 11, 2016

(30) Foreign Application Priority Data

Aug. 7, 2014 (EP) ..... 14180170
Jul. 9, 2015 (EP) ..... 15175992

(51) Int. Cl.

| | |
|---|---|
| ***C11D 1/22*** | (2006.01) |
| ***C11D 1/29*** | (2006.01) |
| ***C11D 1/72*** | (2006.01) |
| ***C11D 1/83*** | (2006.01) |
| ***C11D 17/04*** | (2006.01) |
| ***C11D 1/66*** | (2006.01) |
| ***C11D 3/20*** | (2006.01) |
| *C11D 1/04* | (2006.01) |

(52) U.S. Cl.

CPC ..... *C11D 1/83* (2013.01); *C11D 1/22* (2013.01); *C11D 1/29* (2013.01); *C11D 1/66* (2013.01); *C11D 1/72* (2013.01); *C11D 3/2075* (2013.01); *C11D 17/043* (2013.01); *C11D 17/045* (2013.01); *C11D 1/04* (2013.01)

(58) Field of Classification Search

CPC .... C11D 1/22; C11D 1/29; C11D 1/72; C11D 1/83; C11D 17/042

See application file for complete search history.

(56) References Cited

U.S. PATENT DOCUMENTS

| | | | | |
|---|---|---|---|---|
| 6,949,498 | B2 | 9/2005 | Murphy et al. | |
| 7,563,757 | B2 | 7/2009 | Kouvroukoglou et al. | |
| 8,492,325 | B2 | 7/2013 | Sadlowski et al. | |
| 8,889,610 | B2 | 11/2014 | Labeque et al. | |
| 8,895,493 | B2 | 11/2014 | Labeque et al. | |
| 2004/0142840 | A1* | 7/2004 | de Buzzaccarini ..... | C11D 1/65 510/296 |
| 2010/0313360 | A1 | 12/2010 | Menting et al. | |
| 2011/0152159 | A1* | 6/2011 | Labeque ..... | C11D 3/505 510/296 |
| 2011/0152163 | A1 | 6/2011 | Labeque et al. | |
| 2011/0319310 | A1 | 12/2011 | Labeque et al. | |
| 2012/0294969 | A1 | 11/2012 | Koch et al. | |

FOREIGN PATENT DOCUMENTS

CA 2 589 983 C 6/2012

OTHER PUBLICATIONS

EP Search Report for Application No. 14180170.4-1357, dated Feb. 11, 2015, 9 pages.

* cited by examiner

*Primary Examiner* — Brian P Mruk
(74) *Attorney, Agent, or Firm* — Melissa Krasovec; Leonard W Lewis; Steven W Miller

(57) ABSTRACT

A liquid laundry detergent composition comprising;
an anionic surfactant, wherein the anionic surfactant comprises linear alkylbenzene sulphonate;
an ethoxylated alcohol non-ionic surfactant;
greater than 5.5% by weight of the composition of water;
wherein the weight ratio of total anionic surfactant:non-ionic surfactant is between 5:1 and 23:1; and
wherein the weight ratio of linear alkylbenzene sulphonate: non-ionic surfactant is between 5:1 and 10:1; and
wherein the weight ratio of total surfactant to water is between 3:1 to 20:1.

16 Claims, No Drawings

LAUNDRY DETERGENT COMPOSITION

FIELD OF THE INVENTION

Laundry detergent composition comprising surfactants.

BACKGROUND OF THE INVENTION

There is a tendency to formulate compacted liquid laundry detergent compositions. These compacted formulations aim to provide the same overall cleaning benefit as more dilute formulations, yet have an overall lower volume. Hence smaller volumes of the composition can be added to the wash liquor and so smaller packages need to be used saving on packaging material, space, transport costs etc, resulting in more environmentally friendly compositions.

However, an issue with compacted formulations is they leave little space available for addition of new technologies. If the formulator wishes to add a new ingredient, they will often have to lower the level of at least one of the other ingredients and so compromise the benefit provided by that ingredient.

Often, in order to add a new ingredient, the level of detergent surfactant needs to be reduced. This negatively impacts the cleaning benefit provided by the laundry detergent composition.

Therefore, there remains a need in the art for a compacted laundry detergent composition that optimises surfactant levels to ensure excellent cleaning whilst still allowing incorporation of new ingredients.

SUMMARY OF THE INVENTION

The present invention is to a liquid laundry detergent composition comprising;

- an anionic surfactant, wherein the anionic surfactant comprises linear alkylbenzene sulphonate;
- an ethoxylated alcohol non-ionic surfactant;
- greater than 5% by weight of the composition of water;
- wherein the weight ratio of total anionic surfactant:non-ionic surfactant is between 5:1 and 23:1; and
- wherein the weight ratio of linear alkylbenzene sulphonate:non-ionic surfactant is between 5:1 and 10:1; and
- wherein the weight ratio of total surfactant to water is between 3:1 to 20:1.

The present invention is also to a water-soluble unit dose article comprising a water-soluble film and a liquid laundry detergent composition according to the present invention.

DETAILED DESCRIPTION OF THE INVENTION

Liquid Laundry Detergent Composition

The composition of the present invention is a liquid laundry detergent composition. The term 'liquid laundry detergent composition' refers to any laundry detergent composition comprising a liquid capable of wetting and treating fabric e.g., cleaning clothing in a domestic washing machine, and includes, but is not limited to, liquids, gels, pastes, dispersions and the like. The liquid composition can include solids or gases in suitably subdivided form, but the liquid composition excludes forms which are non-fluid overall, such as tablets or granules.

The liquid composition may be formulated into a unit dose article. The unit dose article of the present invention comprises a water-soluble film which fully encloses the liquid composition in at least one compartment. Suitable unit dose articles are described in more detail below.

The liquid laundry detergent composition can be used as a fully formulated consumer product, or may be added to one or more further ingredient to form a fully formulated consumer product. The liquid laundry detergent composition may be a 'pre-treat' composition which is added to a fabric, preferably a fabric stain, ahead of the fabric being added to a wash liquor.

The liquid laundry detergent composition can be used in a fabric hand wash operation or may be used in an automatic machine fabric wash operation.

The liquid laundry detergent composition of the present invention comprises an anionic surfactant. The anionic surfactant comprises linear alkylbenzene sulphonate. Suitable anionic surfactants are described in more detail below. The liquid laundry detergent composition may comprise between 20 wt % and 42 wt %, or even between 25 wt % and 40 wt % or even between 30 wt % and 40 wt % anionic surfactant. The liquid laundry detergent composition may comprise between 15 wt % and 25 wt % linear alkybenzene sulphonate.

The liquid laundry detergent composition of the present invention comprises an ethoxylated alcohol non-ionic surfactant. Suitable ethoxylated alcohol non-ionic surfactants are described in more detail below. The liquid laundry detergent composition may comprise between 0.5 wt % and 7.5 wt %, or even between 1 wt % and 5 wt % ethoxylated alcohol non-ionic surfactant.

The liquid laundry detergent composition comprises water. The liquid laundry detergent composition may comprise between 0.5 wt % and 20 wt % water.

The weight ratio of total anionic surfactant:non-ionic surfactant in the liquid laundry detergent composition is between 5:1 and 23:1 or even between 7:1 and 23:1. The weight ratio of anionic to non-ionic surfactant in the liquid laundry detergent composition may be from 5:1 to 20:1, or even 5:1 to 15:1. By 'weight ratio' we herein mean the ratio of the weight of a first ingredient present in the composition to that of the weight of a second ingredient present in the composition.

By 'total anionic surfactant' we herein mean the sum total of all the anionic surfactant present in the liquid laundry detergent composition.

The ratio of linear alkylbenzene sulphonate:non-ionic surfactant in the liquid laundry detergent composition is between 4:1 and 10:1 or even between 5:1 and 10:1, or even between 6:1 and 10:1.

The ratio of total surfactant to water in the liquid laundry detergent composition is between 3:1 to 20:1. By 'total surfactant', we herein mean the level of all surfactant present in the liquid laundry detergent composition, including but not limited to all anionic, non-ionic and cationic surfactant.

It is understood that the term 'surfactant' does not include fatty acids or neutralized equivalents thereof. The liquid laundry detergent composition may comprise between 5 wt % and 15 wt % fatty acid, or even between 8 wt % and 15 wt % fatty acid.

The liquid laundry detergent composition may comprise a laundry adjunct ingredient. Suitable laundry adjunct ingredients are described in more detail below.

The liquid laundry detergent composition may comprise a solvent. Suitable solvents are detailed below. The term 'solvent' does not include water. The molar ratio of total solvent to total surfactant may be between 1:1 and 1:3, or even between 1:4 and 1:2.5. By 'total solvent' we herein mean all solvent present in the liquid laundry detergent composition. By 'total surfactant', we herein mean the level of all surfactant present in the liquid laundry detergent composition, including but not limited to all anionic, non-ionic and cationic surfactant. By molar ratio we herein mean the ratio of the moles of total solvent to the moles of total surfactant present in the composition.

The composition may have a pH of from 5-10, preferably from 6-9.

Water-Soluble Unit Dose Article

The present invention is also to a water-soluble unit dose article comprising a water-soluble film and a liquid laundry detergent composition according to the present invention.

The unit dose pouch of the present invention comprises a water-soluble film which fully encloses the liquid composition in at least one compartment.

The unit dose article herein is typically a closed structure, made of the water-soluble film enclosing an internal volume which comprises the liquid laundry detergent composition. The pouch can be of any form and shape which is suitable to hold and protect the composition, e.g. without allowing the release of the composition from the pouch prior to contact of the pouch to water. The exact execution will depend on factors like the type and amount of the composition in the pouch, the number of compartments in the pouch, the characteristics required for the water-soluble film to hold, protect, and release the composition. The unit dose article may have a substantially, square, rectangular, oval, elliptoid, superelliptical, or circular shape. The shape may or may not include any excess material present as a flange or skirt at the point where two or more films are sealed together. By "substantially", we herein mean that the shape has an overall impression of being for example square. It may have rounded corners and/or non-straight sides, but overall it gives the impression of being square for example.

The liquid composition preferably has density in the range from of 0.9 to 1.3 grams per cubic centimeter, more preferably from 1.0 to 1.1 grams per cubic centimeter, excluding any solid additives, but including any bubbles, if present.

The unit dose article comprises a water-soluble film which fully encloses the liquid composition in at least one compartment. The unit dose article may optionally comprise additional compartments; said additional compartments may comprise an additional composition. Said additional composition may be liquid, solid, or mixtures thereof. Alternatively, any additional solid component may be suspended in a liquid-filled compartment. Each compartment may have the same or different compositions. A multi-compartment unit dose form may be desirable for such reasons as: separating chemically incompatible ingredients; or where it is desirable for a portion of the ingredients to be released into the wash earlier or later. The unit dose article may comprise at least one, or even at least two, or even at least three, or even at least four, or even at least five compartments. The unit dose article may comprise two compartments, wherein a first compartment comprises from 5% to 20% by weight of the compartment of a chelant, preferably wherein the chelant is in a solid form.

The multiple compartments may be arranged in any suitable orientation. For example the unit dose article may comprise a bottom compartment, and at least a first top compartment, wherein the top compartment is superposed onto the bottom compartment. The unit dose article may comprise a bottom compartment and at least a first and a second top compartment, wherein the top compartments are arranged side-by-side and are superposed on the bottom compartment; preferably, wherein the article comprises a bottom compartment and at least a first, a second and a third top compartment, wherein the top compartments are arranged side-by-side and are superposed on the bottom compartment.

Alternatively, the compartments may all be positioned in a side-by-side arrangement. In such an arrangement the compartments may be connected to one another and share a dividing wall, or may be substantially separated and simply held together by a connector or bridge. Alternatively, the compartments may be arranged in a 'tyre and rim' orientation, i.e. a first compartment is positioned next to a second compartment, but the first compartment at least partially surrounds the second compartment, but does not completely enclose the second compartment The film of the unit dose article is soluble or dispersible in water, and preferably has a water-solubility of at least 50%, preferably at least 75% or even at least 95%, as measured by the method set out here after using a glass-filter with a maximum pore size of 20 microns:

50 grams±0.1 gram of film material is added in a pre-weighed 400 ml beaker and 245 ml±1 ml of distilled water is added. This is stirred vigorously on a magnetic stirrer set at 600 rpm, for 30 minutes. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

Preferred film materials are preferably polymeric materials. The film material can, for example, be obtained by casting, blow-moulding, extrusion or blown extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000.

Mixtures of polymers can also be used as the film material. This can be beneficial to control the mechanical and/or dissolution properties of the compartments or pouch, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of about 10,000-40,000, preferably around 20,000, and of PVA or copolymer thereof, with a weight average molecular weight of about 100,000 to 300,000, preferably around 150,000. Also suitable herein are polymer blend compositions, for example comprising hydrolytically degradable and water-soluble polymer blends such as polylactide and polyvinyl alcohol, obtained by mixing polylactide and polyvinyl alcohol, typically comprising about 1-35% by weight polylactide and about 65% to 99% by weight polyvinyl alcohol. Preferred for use herein are polymers which are from about 60% to about 98% hydrolysed, preferably about 80% to about 90% hydrolysed, to improve the dissolution characteristics of the material.

Preferred films exhibit good dissolution in cold water, meaning unheated water straight from the tap. Preferably such films exhibit good dissolution at temperatures below 25° C., more preferably below 21° C., more preferably below 15° C. By good dissolution it is meant that the film exhibits water-solubility of at least 50%, preferably at least 75% or even at least 95%, as measured by the method set out here after using a glass-filter with a maximum pore size of 20 microns, described above.

Preferred films are those supplied by Monosol under the trade references M8630, M8900, M8779, M8310, films described in U.S. Pat. No. 6,166,117 and U.S. Pat. No. 6,787,512 and PVA films of corresponding solubility and deformability characteristics. Further preferred films are those describes in US2006/0213801, WO 2010/119022, US2011/0188784 and U.S. Pat. No. 6,787,512.

Preferred water soluble films are those resins comprising one or more PVA polymers, preferably said water soluble film resin comprises a blend of PVA polymers. For example, the PVA resin can include at least two PVA polymers, wherein as used herein the first PVA polymer has a viscosity less than the second PVA polymer. A first PVA polymer can have a viscosity of at least 8 cP (cP mean centipoise), 10 cP, 12 cP, or 13 cP and at most 40 cP, 20 cP, 15 cP, or 13 cP, for example in a range of about 8 cP to about 40 cP, or 10 cP to about 20 cP, or about 10 cP to about 15 cP, or about 12 cP to about 14 cP, or 13 cP. Furthermore, a second PVA polymer can have a viscosity of at least about 10 cP, 20 cP, or 22 cP and at most about 40 cP, 30 cP, 25 cP, or cP, for example in a range of about 10 cP to about 40 cP, or 20 to about 30 cP, or about 20 to about 25 cP, or about 22 to about 24, or about 23 cP. The viscosity of a PVA polymer is determined by measuring a freshly made solution using a Brookfield LV type viscometer with UL adapter as described in British Standard EN ISO 15023-2:2006 Annex E Brookfield Test method. It is international practice to state the viscosity of 4% aqueous polyvinyl alcohol solutions at 20 .deg.C. All viscosities specified herein in cP should be understood to refer to the viscosity of 4% aqueous polyvinyl alcohol solution at 20 .deg.C., unless specified otherwise. Similarly, when a resin is described as having (or not having) a particular viscosity, unless specified otherwise, it is intended that the specified viscosity is the average viscosity for the resin, which inherently has a corresponding molecular weight distribution.

The individual PVA polymers can have any suitable degree of hydrolysis, as long as the degree of hydrolysis of the PVA resin is within the ranges described herein. Optionally, the PVA resin can, in addition or in the alternative, include a first PVA polymer that has a Mw in a range of about 50,000 to about 300,000 Daltons, or about 60,000 to about 150,000 Daltons; and a second PVA polymer that has a Mw in a range of about 60,000 to about 300,000 Daltons, or about 80,000 to about 250,000 Daltons.

The PVA resin can still further include one or more additional PVA polymers that have a viscosity in a range of about 10 to about 40 cP and a degree of hydrolysis in a range of about 84% to about 92%.

When the PVA resin includes a first PVA polymer having an average viscosity less than about 11 cP and a polydispersity index in a range of about 1.8 to about 2.3, then in one type of embodiment the PVA resin contains less than about 30 wt. % of the first PVA polymer. Similarly, when the PVA resin includes a first PVA polymer having an average viscosity less than about 11 cP and a polydispersity index in a range of about 1.8 to about 2.3, then in another, non-exclusive type of embodiment the PVA resin contains less than about 31) wt % of a PVA polymer having a Mw less than about 70,000 Daltons.

Of the total PVA resin content in the film described herein, the PVA resin can comprise about 30 to about 85 wt. % of the first PVA polymer, or about 45 to about 55 wt. % of the first PVA polymer. For example, the PVA resin can contain about 50 wt. % of each PVA polymer, wherein the viscosity of the first PVA polymer is about 13 cP and the viscosity of the second PVA polymer is about 23 cP.

One type of embodiment is characterized by the PVA resin including about 40 to about 85 wt. % of a first PVA polymer that has a viscosity in a range of about 10 to about 15 cP and a degree of hydrolysis in a range of about 84% to about 92%. Another type of embodiment is characterized by the PVA resin including about 45 to about 55 wt. % of the first PVA polymer that has a viscosity in a range of about 10 to about 15 cP and a degree of hydrolysis in a range of about 84% to about 92%. The PVA resin can include about 15 to about 60 wt. % of the second PVA polymer that has a viscosity in a range of about 20 to about 25 cP and a degree of hydrolysis in a range of about 84% to about 92%. One contemplated class of embodiments is characterized by the PVA resin including about 45 to about 55 wt. % of the second PVA polymer.

When the PVA resin includes a plurality of PVA polymers the PDI value of the PVA resin is greater than the PDI value of any individual, included PVA polymer. Optionally, the PDI value of the PVA resin is greater than 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.5, or 5.0.

The film material herein can also comprise one or more additive ingredients. For example, it can be beneficial to add plasticisers, for example glycerol, ethylene glycol, diethyleneglycol, propylene glycol, sorbitol and mixtures thereof. Other additives may include water and functional detergent additives, including water, to be delivered to the wash water, for example organic polymeric dispersants, etc.

The film may be opaque, transparent or translucent. The film may comprise a printed area. The printed area may cover between 10 and 80% of the surface of the film; or between 10 and 80% of the surface of the film that is in contact with the internal space of the compartment; or between 10 and 80% of the surface of the film and between 10 and 80% of the surface of the compartment.

The area of print may cover an uninterrupted portion of the film or it may cover parts thereof, i.e. comprise smaller areas of print, the sum of which represents between 10 and 80% of the surface of the film or the surface of the film in contact with the internal space of the compartment or both.

The area of print may comprise inks, pigments, dyes, blueing agents or mixtures thereof. The area of print may be opaque, translucent or transparent.

The area of print may comprise a single colour or maybe comprise multiple colours, even three colours. The area of print may comprise white, black, blue, red colours, or a mixture thereof. The print may be present as a layer on the surface of the film or may at least partially penetrate into the film. The film will comprise a first side and a second side. The area of print may be present on either side of the film, or be present on both sides of the film. Alternatively, the area of print may be at least partially comprised within the film itself.

The area of print may comprise an ink, wherein the ink comprises a pigment. The ink for printing onto the film has preferably a desired dispersion grade in water. The ink may be of any color including white, red, and black. The ink may be a water-based ink comprising from 10% to 80% or from 20% to 60% or from 25% to 45% per weight of water. The ink may comprise from 20% to 90% or from 40% to 80% or from 50% to 75% per weight of solid.

The ink may have a viscosity measured at 20° C. with a shear rate of 1000 $s^{-1}$ between 1 and 600 cPs or between 50 and 350 cPs or between 100 and 300 cPs or between 150 and 250 cPs. The measurement may be obtained with a cone-plate geometry on a TA instruments AR-550 Rheometer.

The area of print may be achieved using standard techniques, such as flexographic printing or inkjet printing. Preferably, the area of print is achieved via flexographic printing, in which a film is printed, then moulded into the shape of an open compartment. This compartment is then filled with a detergent composition and a second film placed over the compartment and sealed to the first film. The area of print may be on either or both sides of the film.

Alternatively, an ink or pigment may be added during the manufacture of the film such that all or at least part of the film is coloured.

The film may comprise an aversive agent, for example a bittering agent. Suitable bittering agents include, but are not limited to, naringin, sucrose octaacetate, quinine hydrochloride, denatonium benzoate, or mixtures thereof. Any suitable level of aversive agent may be used in the film. Suitable levels include, but are not limited to, 1 to 5000 ppm, or even 100 to 2500 ppm, or even 250 to 2000 rpm.

Anionic Surfactant

The anionic surfactant may be selected from linear alkyl benzene sulfonate, alkyl ethoxylate sulphate and combinations thereof.

Suitable anionic surfactants useful herein can comprise any of the conventional anionic surfactant types typically used in liquid detergent products. These include the alkyl benzene sulfonic acids and their salts as well as alkoxylated or non-alkoxylated alkyl sulfate materials.

Exemplary anionic surfactants are the alkali metal salts of $C_{10}$-$C_{16}$ alkyl benzene sulfonic acids, or $C_{11}$-$C_{14}$ alkyl benzene sulfonic acids. In one aspect, the alkyl group is linear and such linear alkyl benzene sulfonates are known as "LAS". Alkyl benzene sulfonates, and particularly LAS, are well known in the art. Such surfactants and their preparation are described for example in U.S. Pat. Nos. 2,220,099 and 2,477,383. Especially useful are the sodium, potassium and amine linear straight chain alkylbenzene sulfonates in which the average number of carbon atoms in the alkyl group is from about 11 to 14. Sodium $C_{11}$-$C_{14}$, e.g., $C_{12}$, LAS is a specific example of such surfactants.

Specific, non-limiting examples of anionic surfactants useful herein include the acid or salt forms of: a) $C_{11}$-$C_{18}$ alkyl benzene sulfonates (LAS); b) $C_{10}$-$C_{20}$ primary, branched-chain and random alkyl sulfates (AS), including predominantly $C_{12}$ alkyl sulfates; c) $C_{10}$-$C_{18}$ secondary (2,3) alkyl sulfates with non-limiting examples of suitable cations including sodium, potassium, ammonium, amine and mixtures thereof; d) $C_{10}$-$C_{18}$ alkyl alkoxy sulfates ($AE_xS$) wherein x is from 1-30; e) $C_{10}$-$C_{18}$ alkyl alkoxy carboxylates in one aspect, comprising 1-5 ethoxy units; f) mid-chain branched alkyl sulfates as discussed in U.S. Pat. No. 6,020,303 and U.S. Pat. No. 6,060,443; g) mid-chain branched alkyl alkoxy sulfates as discussed in U.S. Pat. No. 6,008,181 and U.S. Pat. No. 6,020,303; h) modified alkylbenzene sulfonate (MLAS) as discussed in WO 99/05243, WO 99/05242, WO 99/05244, WO 99/05082, WO 99/05084, WO 99/05241, WO 99/07656, WO 00/23549, and WO 00/23548; i) methyl ester sulfonate (MES); and j) alpha-olefin sulfonate (AOS).

A suitable anionic detersive surfactant is predominantly alkyl $C_{16}$ alkyl mid-chain branched sulphate. A suitable feedstock for predominantly alkyl $C_{16}$ alkyl mid-chain branched sulphate is beta-farnesene, such as BioFene™ supplied by Amyris, Emeryville, Calif.

Ethoxylated Alcohol Non-Ionic Surfactant

The ethoxylated nonionic surfactant may be, e.g., primary and secondary alcohol ethoxylates, especially the $C_8$-$C_{20}$ aliphatic alcohols ethoxylated with an average of from 1 to 50 or even 20 moles of ethylene oxide per mole of alcohol, and more especially the $C_{10}$-$C_{15}$ primary and secondary aliphatic alcohols ethoxylated with an average of from 1 to 10 moles of ethylene oxide per mole of alcohol. Non-ethoxylated alcohol nonionic surfactants include alkylpolyglycosides, glycerol monoethers, and polyhydroxyamides (glucamide).

The ethoxylated alcohol non-ionic surfactant can be, for example, a condensation product of from 3 to 8 mol of ethylene oxide with 1 mol of a primary alcohol having from 9 to 15 carbon atoms.

The non-ionic surfactant may comprise a fatty alcohol ethoxylate of formula $R(EO)_n$, wherein R represents an alkyl chain between 4 and 30 carbon atoms, (EO) represents one unit of ethylene oxide monomer and n has an average value between 0.5 and 20.

Adjunct Ingredients

The adjunct laundry detergent ingredient may be selected from bleach, bleach catalyst, dye, hueing agents, cleaning polymers, alkoxylated polyamines, polyethyleneimines, alkoxylated polyethyleneimines, soil release polymers, amphiphilic graft polymers, surfactants, solvents, dye transfer inhibitors, chelants, enzymes, perfumes, encapsulated perfumes, perfume delivery agents, suds suppressor, brighteners, polycarboxylates, structurants, anti-oxidants, deposition aids and mixtures thereof.

Hueing Dye:

The liquid laundry detergent composition may comprise a hueing dye. The hueing dyes employed in the present laundry care compositions may comprise polymeric or non-polymeric dyes, pigments, or mixtures thereof. Preferably the hueing dye comprises a polymeric dye, comprising a chromophore constituent and a polymeric constituent. The chromophore constituent is characterized in that it absorbs light in the wavelength range of blue, red, violet, purple, or combinations thereof upon exposure to light. In one aspect, the chromophore constituent exhibits an absorbance spectrum maximum from about 520 nanometers to about 640 nanometers in water and/or methanol, and in another aspect, from about 560 nanometers to about 610 nanometers in water and/or methanol.

Although any suitable chromophore may be used, the dye chromophore is preferably selected from benzodifuranes, methine, triphenylmethanes, napthalimides, pyrazole, napthoquinone, anthraquinone, azo, oxazine, azine, xanthene, triphenodioxazine and phthalocyanine dye chromophores. Mono and di-azo dye chromophores are preferred.

The hueing dye may comprise a dye polymer comprising a chromophore covalently bound to one or more of at least three consecutive repeat units. It should be understood that the repeat units themselves do not need to comprise a chromophore. The dye polymer may comprise at least 5, or at least 10, or even at least 20 consecutive repeat units.

The repeat unit can be derived from an organic ester such as phenyl dicarboxylate in combination with an oxyalkyleneoxy and a polyoxyalkyleneoxy. Repeat units can be derived from alkenes, epoxides, aziridine, carbohydrate including the units that comprise modified celluloses such as hydroxyalkylcellulose; hydroxypropyl cellulose; hydroxypropyl methylcellulose; hydroxybutyl cellulose; and, hydroxybutyl methylcellulose or mixtures thereof. The repeat units may be derived from alkenes, or epoxides or mixtures thereof. The repeat units may be C2-C4 alkyleneoxy groups, sometimes called alkoxy groups, preferably derived from C2-C4 alkylene oxide. The repeat units may be C2-C4 alkoxy groups, preferably ethoxy groups.

For the purposes of the present invention, the at least three consecutive repeat units form a polymeric constituent. The polymeric constituent may be covalently bound to the chromophore group, directly or indirectly via a linking group. Examples of suitable polymeric constituents include polyoxyalkylene chains having multiple repeating units. In one aspect, the polymeric constituents include polyoxyalkylene chains having from 2 to about 30 repeating units, from 2 to about 20 repeating units, from 2 to about 10 repeating units or even from about 3 or 4 to about 6 repeating units. Non-limiting examples of polyoxyalkylene chains include ethylene oxide, propylene oxide, glycidol oxide, butylene oxide and mixtures thereof.

Chelant:

The compositions herein may also optionally contain one or more copper, iron and/or manganese chelating agents. If utilized, chelating agents will generally comprise from about 0.1% by weight of the compositions herein to about 15%, or even from about 3.0% to about 15% by weight of the compositions herein. Suitable chelants may be selected from: diethylene triamine pentaacetate, diethylene triamine penta(methyl phosphonic acid), ethylene diamine-N'N'-disuccinic acid, ethylene diamine tetraacetate, ethylene diamine tetra(methylene phosphonic acid), hydroxyethane di(methylene phosphonic acid), and any combination thereof. A suitable chelant is ethylene diamine-N'N'-disuccinic acid (EDDS) and/or hydroxyethane diphosphonic acid (HEDP). The laundry detergent composition may comprise ethylene diamine-N'N'-disuccinic acid or salt thereof. The ethylene diamine-N'N'-disuccinic acid may be in S,S enantiomeric form. The composition may comprise 4,5-dihydroxy-m-benzenedisulfonic acid disodium salt, glutamic acid-N,N-diacetic acid (GLDA) and/or salts thereof, 2-hydroxypyridine-1-oxide, Trilon P™ from BASF, Ludwigshafen, Germany. Suitable chelants may also be calcium carbonate crystal growth inhibitors. Suitable calcium carbonate crystal growth inhibitors may be selected from the group consisting of: 1-hydroxyethanediphosphonic acid (HEDP) and salts thereof; N,N-dicarboxymethyl-2-aminopentane-1,5-dioic acid and salts thereof; 2-phosphonobutane-1,2,4-tricarboxylic acid and salts thereof; and any combination thereof.

The composition may comprise a calcium carbonate crystal growth inhibitor, such as one selected from the group consisting of: 1-hydroxyethanediphosphonic acid (HEDP) and salts thereof; N,N-dicarboxymethyl-2-aminopentane-1,5-dioic acid and salts thereof; 2-phosphonobutane-1,2,4-tricarboxylic acid and salts thereof; and any combination thereof.

Polymers:

Suitable polymers include carboxylate polymers, polyethylene glycol polymers, polyester soil release polymers such as terephthalate polymers, amine polymers, cellulosic polymers, dye transfer inhibition polymers, dye lock polymers such as a condensation oligomer produced by condensation of imidazole and epichlorhydrin, optionally in ratio of 1:4:1, hexamethylenediamine derivative polymers, and any combination thereof.

Other polymers include hydroxyethyl cellulose polymer. Preferably, the hydroxyethyl cellulose polymer is derivatised with trimethyl ammonium substituted epoxide. The cellulose polymer may have a molecular weight of between 100,000 and 800,000 daltons. The hydroxyethyl cellulose polymer may be added to the composition as a particle. It may be present in the composition of the particle or may be also be present as a liquid, or a mixture thereof.

Enzymes:

The compositions can comprise one or more detergent enzymes which provide cleaning performance and/or fabric care benefits. Examples of suitable enzymes include, but are not limited to, hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, and amylases, or mixtures thereof. A typical combination is a cocktail of conventional applicable enzymes like protease, lipase, cutinase and/or cellulase in conjunction with amylase.

Fatty Acid:

The composition of the present invention may comprise a fatty acids or fatty acid salts. The fatty acids are carboxylic acids which are often with a long unbranched aliphatic tail, which is either saturated or unsaturated. Suitable fatty acids or salts of the fatty acids for the present invention are preferably sodium salts, preferably C12-C18 saturated and/or unsaturated fatty acids more preferably C12-C14 saturated and/or unsaturated fatty acids and alkali or alkali earth metal carbonates preferably sodium carbonate.

Preferably the fatty acids are selected from the group consisting of lauric acid, myristic acid, palmitic acid, stearic acid, topped palm kernel fatty acid, coconut fatty acid and mixtures thereof.

The composition may comprise from 2% to 18% fatty acid by weight of the composition, or even from 4% to 13% fatty acids by weight of the composition and most preferably from 5% to 10% fatty acids by the weight of the composition.

Without wishing to be bound by theory, surprisingly it was found that the presence of fatty acid provided the additional benefit of reducing suds and hence providing improved cleaning.

Solvent:

The composition may comprise a solvent. The solvent preferably has molecular weight of less than 1500, more preferably less than 1000, even more preferably less than 700. The solvent preferably has a molecular weight of greater than 10, more preferably greater than 100. The solvent preferably has a c Log P of greater than −1.0 and more preferably less than +10. The solvent preferably has a Hydrogen bonding component ($\delta_h$) of less than 20.5, and preferably greater than 10.

The solvent may be selected from alcohols, diols, monoamine derivatives, glycols, or mixtures thereof. Suitable glycols may be selected from polyalkylane glycols, polyalkylene glycols or mixtures thereof. Suitable polyalkyelen glycols include polyethylene glycol. Suitable diols include propane diol, preferably 1,2-propanediol. Monoamine derivatives may comprise monoethanolamine.

The solvent may be selected from the group comprising of polyethylene glycol (PEG) polymer having molecular weight between 300 and 600, dipropylene glycol (DPG), nbutoxy propoxy propanol (nBPP) and mixtures thereof. More preferably the solvent may be selected from the group comprising polyethylene glycol (PEG) polymer having molecular weight between 400 and 600, dipropylene glycol (DPG), nbutoxy propoxy propanol (nBPP) and mixtures thereof.

Structurant:

The composition may comprise a structurant. Any suitable structurant may be used, however hydrogenated castor oil structurants such as commercially available Thixcin are preferred. The structurant may be selected from non-polymeric or polymeric structurants. The structurant may be a non-polymeric structurant, preferably a crystallisable glyceride. The structurant may be a polymeric structurant, preferably a fibre based polymeric structurant, more preferably a cellulose based fibre-based structurant.

Other polymeric structurants are selected from the group consisting of: hydrophobically-modified ethoxylated urethanes (HEUR); hydrophobically modified alkali swellable emulsion (HASE), and mixtures thereof.

Suds Suppressor:

The composition may comprise a suds suppressor, preferably a siloxane-based polymer suds suppressor (herein also referred to simply as 'suds suppressor'). The suds suppressor may be an organomodified siloxane polymer. The organomodified siloxane polymers may comprise aryl or alkylaryl substituents optionally combined with silicone resin and/or modified silica. In one embodiment, the suds suppressor is selected from organomodified silicone polymers with aryl or alkylaryl substituents combined with silicone resin and optionally a primary filler. Particularly preferred are silicone suds suppressor compounds consisting of organomodified silicone polymers with aryl or alkyaryl substituents combined with silicone resin and modified silica as described in U.S. Pat. Nos. 6,521,586 B1, 6,521,587 B1, US Patent Applications 2005 0239908 A1, 2007 01673 A1 to Dow Corning Corp. and US Patent Application 2008 0021152 A1 to Wacker Chemie AG.

Anti-Oxidant:

The liquid laundry detergent composition may comprise an anti-oxidant. The antioxidant is preferably selected from the group consisting of butylated hydroxyl toluene (BHT), butylated hydroxyl anisole (BHA), trimethoxy benzoic acid (TMBA), α, β, λ, and δ tocophenol (vitamin E acetate), 6 hydroxy-2,5,7,8-tetra-methylchroman-2-carboxylic acid (trolox), 1,2, benzisothiazoline-3-one (proxel GLX), tannic acid, galic acid, Tinoguard AO-6, Tinoguard TS, ascorbic acid, alkylated phenol, ethoxyquine 2,2,4 trimethyl, 1-2-dihydroquinoline, 2,6 di or tert or butyl hydroquinone, tert, butyl, hydroxyl anisole, lignosulphonic acid and salts thereof, benzofuran, benzopyran, tocopherol sorbate, butylated hydroxyl benzoic acid and salts thereof, galic acid and its alkyl esters, uric acid, salts thereof and alkyl esters, sorbic acid and salts thereof, dihydroxy fumaric acid and salts thereof, and mixtures thereof. Preferred antioxidants are those selected from the group consisting of alkali and alkali earth metal sulfites and hydrosulfites, more preferably sodium sulfite or hydrosulfite.

Water:

The liquid laundry detergent composition comprises greater than 5% by weight of the composition of water. The liquid laundry detergent composition may comprise greater than 6%, or even greater than 7% or even greater than 8% by weight of the composition of water.

The liquid laundry detergent composition may comprise less than 50%, or even less than 40% or even less than 30% by weight of water. The liquid laundry detergent composition may comprise from 5.5% to 30%, or even from 5.5% to 20% or even from 6% to 15% by weight of the composition of water.

Process of Making

Any suitable process can be used to make the composition of the present invention. Those skilled in the art will know suitable process known the art.

Method of Use

The composition or unit dose article of the present invention can be added to a wash liquor to which laundry is already present, or to which laundry is added. It may be used in an automatic washing machine operation and added directly to the drum or to the dispenser drawer. It may be used in combination with other laundry detergent compositions such as fabric softeners or stain removers. It may be used as pre-treat composition on a stain prior to being added to a wash liquor.

EXAMPLES

The following compositions were prepared and encapsulated in a PVA-film (multi compartment).

TABLE 1

| Ingredients (All levels are in weight percent of the composition.) | A | B |
|---|---|---|
| Usage (g) | 25.36 | 24.34 |
| Usage (ml) | 23.70 | 22.43 |
| Wash Volume (L) | 64 | 64 |
| Linear $C_9$-$C_{15}$ Alkylbenzene sulfonic acid | 18.25 | 22.46 |
| HC24/25 AE2/3S 90/10 blend | 8.73 | 15.29 |
| $C_{12-14}$ alkyl 9-ethoxylate | 15.56 | 3.82 |
| Anionic/Nonionic ratio | 1.73 | 9.9 |
| Citric Acid | 0.65 | 1.55 |
| Fatty acid | 6.03 | 6.27 |
| Chelants | 1.16 | 0.62 |
| Cleaning polymers | 7.42 | 5.33 |
| Enzymes | 0.11 | 0.12 |
| Brightener 49 | 0.18 | 0.19 |
| Structurant | 0.10 | 0.10 |
| Solvent system* | 20.31 | 17.96 |
| Water | 10.31 | 11.66 |
| Perfume | 1.63 | 1.70 |
| Aesthetics | 1.48 | 1.13 |
| Mono-ethanolamine or NaOH (or mixture thereof) | 6.69 | 9.75 |
| Other laundry adjuncts/minors | | |

*May include, but not limited to propanediol, glycerol, ethanol, dipropyleneglycol, polyetheyleneglycol, polypropyleneglycol.

Stained fabric swatches were prepared. Before the wash test, the test stains visibility were measured using a colorimeter. Each stain was measured individually. These starting values were recorded to calculate the percentage removal of each individual test stain after the wash. Formulations A&B, encapsulated in a PVA-film (multi compartment), were washed (Kenmore washing machine, Normal/Regular Cycle at 32° C., 1.5 mmol/L water hardness) together with stained fabrics (2 replicates per stain/cycle) and 2.5 kg of mixed (cotton and poly-cotton) ballast load.

After the wash cycle, the stained fabrics were tumble dried. This wash process was repeated 4 times, each time with fresh stains, resulting in a total of 8 replicates/stain. Within 24 hrs after the wash tests, the residual visibility of the stains on the fabrics were measured. The percentage Stain Removal Index of each stain were calculated using $$\% \text{ SRI}=(\text{Color}_{Fresh\ stain}-\text{Color}_{Washed\ stain})/(\text{Color}_{Fresh\ stain})*100\%$$

To calculate stain removal difference between A&B we calculated % $SRI_B$–% $SRI_A$. Positive values connote better stain removal performance for B.

TABLE 2

| | % SRI A | % SRI B | Δ B vs A |
|---|---|---|---|
| Bacon Grease | 55.5 | 59.8 | 4.3 |
| Burnt Butter | 57.3 | 62.8 | 5.5 |
| Canola Oil | 12.3 | 12.7 | 0.4 |
| Hamburger Grease | 46.6 | 50.1 | 3.5 |
| Lipstick | 15.5 | 19.1 | 3.6 |
| Make up | 9.4 | 11.4 | 2.0 |
| Average | 32.8 | 36.0 | 3.2 |

As can be seen from Table 2, composition according to the present invention provided better stain removal of all stain types even though the overall volume of composition used was less than the composition outside of the scope of the claims. In other words, the compositions according to the present invention provide free space for incorporation of further cleaning actives without compromising cleaning effectiveness.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm" Unless stated otherwise, "wt %" is the weight percentage, by weight of the composition.

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition of the same term in a document incorporated by reference, the meaning of definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A water-soluble unit dose article comprising a water-soluble film and a liquid laundry detergent composition comprising:

an anionic surfactant, wherein the anionic surfactant comprises linear alkylbenzene sulphonate;

an ethoxylated alcohol non-ionic surfactant;

greater than about 5% by weight of the composition of water;

wherein the weight ratio of total anionic surfactant:non-ionic surfactant is between about 5:1 and about 23:1; and wherein the weight ratio of linear alkylbenzene sulphonate: non-ionic surfactant is between about 5:1 and about 10:1; and wherein the weight ratio of total surfactant to water is between about 3:1 to about 20:1, wherein 'total anionic surfactant' means the sum total of all the anionic surfactant present in the liquid laundry detergent composition, and wherein 'total surfactant' means the level of all surfactant present in the liquid laundry detergent composition, including but not limited to all anionic, non-ionic and cationic surfactant but wherein 'surfactant' does not include fatty acids or neutralized equivalents thereof; and wherein the water-soluble unit dose article comprises at least two compartments.

2. A water-soluble unit dose article according to claim 1 wherein the weight ratio of total anionic surfactant:non-ionic surfactant in said composition is between about 7:1 and about 23:1.

3. A water-soluble unit dose article according to claim 1 wherein the weight ratio of linear alkylbenzene sulphonate: non-ionic surfactant in said composition is between about 6:1 and about 10:1.

4. A water-soluble unit dose article according to claim 3 wherein said composition comprises between about 20 wt % and about 42 wt % anionic surfactant.

5. A water-soluble unit dose article according to claim 4 wherein said composition comprises between about 30 wt % and about 40 wt % anionic surfactant.

6. A water-soluble unit dose article according to claim 1, wherein said anionic surfactant comprises alkyl ethoxylate sulphate.

7. A water-soluble unit dose article according to claim 1 comprising between about 15 wt % and about 25 wt % linear alkybenzene sulphonate.

8. A water-soluble unit dose article according to claim 1 comprising between about 0.5 wt % and about 7.5 wt % linear alkybenzene sulphonate.

9. A water-soluble unit dose article according to claim 1, comprising between about 1 wt % and about 5 wt % non-ionic surfactant.

10. A water-soluble unit dose article according to claim 1 wherein said non-ionic surfactant comprises a fatty alcohol ethoxylate of formula $R(EO)_n$, wherein R represents an alkyl chain between about 4 and about 30 carbon atoms, (EO) represents one unit of ethylene oxide monomer and n has an average value between about 0.5 and about 20.

11. A water-soluble unit dose article according to claim 1 wherein said composition comprises between about 5 wt % and about 15 wt % fatty acid.

12. A water-soluble unit dose article according to claim 1 wherein said composition comprises between about 5.5 wt % and about 20 wt % water.

13. A water-soluble unit dose article according to claim 1 wherein said composition comprises an adjunct laundry detergent ingredient, wherein the adjunct laundry detergent ingredient is selected from bleach, bleach catalyst, dye, hueing agents, cleaning polymers, alkoxylated polyamines, polyethyleneimines, alkoxylated polyethyleneimines, soil release polymers, amphiphilic graft polymers, surfactants, solvents, dye transfer inhibitors, chelants, enzymes, perfumes, encapsulated perfumes, perfume delivery agents, suds suppressor, brighteners, polycarboxylates, structurants, anti-oxidants, deposition aids and mixtures thereof.

14. A water-soluble unit dose article according to claim 1 wherein said composition comprises a solvent selected from alcohols, diols, monoamine derivatives, glycols, or mixtures thereof, wherein the molar ratio of total solvent to total surfactant is between about 1:1 and about 1:3.

15. The water-soluble unit dose article according to claim 1 comprising at least three compartments.

16. The water-soluble unit dose article according to claim 1 where the compartments are arranged in a superposed orientation or in a side-by-side orientation.

* * * * *